US007052385B1

(12) United States Patent
Swartz

(10) Patent No.: US 7,052,385 B1
(45) Date of Patent: May 30, 2006

(54) SELF-ALIGNING BLADE ANGLE GUIDE

(76) Inventor: Ronald Swartz, 247 Morris Turnpike, Newton, NJ (US) 07860

( * ) Notice: Subject to any disclaimer, the term of this patent is extended or adjusted under 35 U.S.C. 154(b) by 162 days.

(21) Appl. No.: 10/656,548

(22) Filed: Sep. 6, 2003

(51) Int. Cl.
*B24B 19/00* (2006.01)

(52) U.S. Cl. ..... 451/367; 451/371; 451/378; 451/391; 76/88; 269/289 MR

(58) Field of Classification Search ..... 76/82–83, 76/88; 451/367, 370, 371, 378, 391, 386, 451/558; 269/289 MR; 29/270, 280; D8/71, D8/91
See application file for complete search history.

(56) References Cited

U.S. PATENT DOCUMENTS

| | | | | | |
|---|---|---|---|---|---|
| 449,673 | A | * | 4/1891 | Francis | 451/367 |
| 560,111 | A | * | 5/1896 | Salot | 451/367 |
| 945,771 | A | | 1/1910 | Ensminger | 51/285 X |
| 1,123,242 | A | * | 1/1915 | Carmon | 451/370 |
| 1,239,494 | A | * | 9/1917 | Lange | 451/370 |
| 1,327,498 | A | | 1/1920 | Summerbell | 451/371 |
| 1,368,218 | A | | 2/1921 | Chenette | 451/175 |
| 1,453,409 | A | | 5/1923 | Scott | 451/371 |
| 1,504,049 | A | * | 8/1924 | Kalteyer | 451/367 |
| 1,504,050 | A | * | 8/1924 | Kalteyer | 451/367 |
| 1,601,339 | A | | 9/1926 | Ballou | 451/232 |
| 1,838,251 | A | * | 12/1931 | Cook | 451/316 |
| 1,934,139 | A | | 11/1933 | Pavitt | 76/81 |
| 2,082,755 | A | | 6/1937 | Polney | 451/316 |
| 2,246,927 | A | * | 6/1941 | Schalow | 451/371 |
| 2,647,351 | A | | 8/1953 | Arnold | 451/463 |
| 2,741,077 | A | * | 4/1956 | Ayer | 451/367 |
| 2,950,585 | A | | 8/1960 | Bell | 51/221 |
| 3,654,823 | A | | 4/1972 | Juranitch | 76/82 |
| 3,797,334 | A | | 3/1974 | Sinclair | 76/88 |
| 3,819,170 | A | | 6/1974 | Longbrake | 269/3 |
| 3,894,362 | A | | 7/1975 | Graves | 51/211 |
| 3,913,903 | A | * | 10/1975 | Seward et al. | 76/82 |
| 3,924,360 | A | | 12/1975 | Haile et al. | 51/221 |
| 3,950,899 | A | * | 4/1976 | Gilbert | 451/370 |
| 4,078,455 | A | | 3/1978 | Brody | 76/88 |
| 4,228,703 | A | | 10/1980 | Moss | 76/86 |
| 4,418,588 | A | | 12/1983 | Byers | 76/88 |
| 4,512,112 | A | | 4/1985 | LeVine | 51/221 |
| 5,094,038 | A | | 3/1992 | Maruyama | 51/216 |
| 5,431,068 | A | | 7/1995 | Alsch | 76/82 |
| 5,845,407 | A | | 12/1998 | Cerrato | 30/459 |
| 5,967,888 | A | * | 10/1999 | Lawhun | 451/367 |
| 6,227,958 | B1 | * | 5/2001 | Neuberg | 451/367 |
| 6,926,596 | B1 | * | 8/2005 | Tarris | 451/367 |
| 2005/0048885 | A1 | * | 3/2005 | Longbrake | 451/367 |

* cited by examiner

*Primary Examiner*—Allan N. Shoap
*Assistant Examiner*—Jason Prone
(74) *Attorney, Agent, or Firm*—Catalina & Associates, P.C.; Richard A. Catalina, Jr.; Tony K. Uhm

(57) ABSTRACT

A device for use in the manual sharpening of arrow broadheads, razor blades and the like includes a unique symmetrical clamp and axle assembly having interchangeable, matched pairs of special purpose jaw members for gripping blades of differing configurations. When coupled to the frame, the clamp and axle assembly is freely rotatable, and this free rotation automatically aligns the length of the edge of the blade with the surface of a whetstone. Additionally these rotational and self-aligning capability enable the user to service both sides of the blade's edge with a single blade clamping operation, by manually rotating the clamp 180 degrees between passes along the surface of the whetstone.

9 Claims, 7 Drawing Sheets

SELF-ALIGNING BLADE ANGLE GUIDE

FEDERALLY SPONSORED RESEARCH

Not Applicable

SEQUENCE LISTING OR PROGRAM

Not Applicable

BACKGROUND

1. Field of Invention

This invention is an improved device for use in the manual sharpening of arrow broadheads, razor blades, and specialty blades.

2. Discussion of Prior Art

The need to sharpen or re-sharpen blades of cutting instruments is ancient. While in theory, the actions involved in the process of sharpening are fairly simple, in practice a good deal of skill is required, and sharpening has been a difficult task for the average person. This is particularly true of smaller blades. This is evidenced by the countless devices that have been designed to aid the user in the process of sharpening, and by the fact that entire industries exist solely to manufacture disposable blades of widely varying style and purpose.

The vast array of prior art devices for aiding in the manual sharpening of blades generally have had a common goal, which is to maintain a fixed angle between an abrasive sharpening surface and a blade as the blade is moved across the sharpening surface, or more recently, as the abrasive surface is moved across the blade. While this aspect of the sharpening process is critical, to efficiently sharpen any blade requires that several actions take place in concert:

1) The blade to be sharpened must move smoothly across an abrasive surface while being held at a fixed angle to the surface.
2) The entire length of the blade edge must come in contact with the abrasive surface at a uniform rate each time the blade is moved across the surface.
3) The blade must be turned over after each completed "pass" across the abrasive surface and a similar pass must be made on the opposite side of the blade.

Step 3 is necessary to insure that a uniform bevel is maintained and because the action of moving the dull blade across the abrasive surface, such as a whetstone has two separate effects on the blade:

a) The portion of the blade edge that is in contact with the abrasive surface or the "underside" is ground away. Defects and deformities are removed and a clean smooth surface is created.
   b) As the underside of the blade edge is ground away, microscopic burrs and filings are formed on the opposite or "top" side of the edge.

These burrs and filings are detrimental to the desired effect of sharpening and continue to build up with each pass across the abrasive surface. In order to minimize this undesirable effect, the blade must be turned over after each completed pass across the abrasive surface and a similar pass must be made on the opposite side. This process is repeated until the blade is sharp. Thus both sides of the blade edge bevel are uniformly ground, burrs and filings are not permitted to build up, and a greater degree of sharpness is achieved.

Devices that hold blades at fixed angles to a sharpening surface are well known in prior art and are known to consist of basically familiar, expected and obvious structural configurations. However, there has been a long-standing need for a device that will securely hold the blade to be sharpened at a fixed angle to the sharpening surface and:

1) ensure that the entire length of the blade edge is uniformly ground on each pass across the sharpening surface, and
2) easily facilitate the superior process of alternately passing each side of the blade across the sharpening surface.
3) enable the user to service both sides of the blades edge with a single blade clamping operation For example, U.S. Pat. No. 3,819,170 Longbrake shows a hand-held device for the sharpening of knives and arrow broadheads consisting of a vise for securing the blade to be sharpened, two individual guide bars mounted at the rear top and bottom of the vise, with each guide bar having a series of holes indicating several angle options, through which a length of rod with a sharpening stone attached to one end is passed, and the stone then is passed across the blade. This device secures the blade at a fixed angle to the sharpening stone but discourages the user from employing the process of alternately passing the stone over each side of the blade's edge, as the rod/stone must be withdrawn from one guide bar, the entire device inverted and the rod/stone reinserted in the corresponding angle hole of the opposite guide bar with each pass of the stone.

U.S. Pat. No. 5,431,068 Alsch depicts a device wherein a blade vise is horizontally mounted midway along a vertical main shaft which is topped with an assembly through which a single rod with multiple sharpening stones of varying grit mounted on one end is semi-permanently attached. Again, this devise does maintain a fixed angle between the blade and the sharpening surface but, the drawback of this system is that the blade must be unclamped, removed, turned over and re-clamped to sharpen the opposite side. This makes the process of sharpening more difficult and time-consuming than necessary. Further, passing the stone alternately over each side of the blade is impractical.

U.S. Pat. No. 3,654,823 Juranitch discloses a device for the sharpening of arrowheads consisting of a two-piece clamp, which grips the arrowhead, and through its shape, also maintains a fixed angle to a sharpening surface, such as a whetstone. Achieving uniform blade-to-stone contact on both sides of the blade is difficult because the blade must be precisely positioned in the clamp, and any misalignment or structural anomaly of the clamp will result in a portion of the blade edge being held above the surface of the whetstone. Additionally, the clamp body rides the surface of the stone, which wears the device itself and clogs the porous surface of the sharpening stone with additional metal filings.

OBJECTS AND ADVANTAGES

Objects and advantages of the invention are to provide a sharpening system which, in addition to maintaining a fixed angle between a blade to be sharpened and the sharpening surface, also;

1) addresses the shortcomings of known prior art,
2) is capable of sharpening blades of varying sizes and configurations with equal efficiency,
3) enables and encourages the user to utilize the superior process of alternately passing each side of the blade across the sharpening surface, 4) insures uniform blade-to-sharpening surface contact throughout the length of the blade,
5) enables the user to service both sides of the blade with a single blade clamping operation,
6) will enable the user, regardless of skill, knowledge or experience, to sharpen blades accurately and proficiently, with minimal effort and minimal opportunity for error.

The invention is designed to encompass and accomplish all the above-mentioned objects as well as others, which will become apparent from a consideration of the ensuing description and drawings.

DESCRIPTION OF THE DRAWINGS

Description—FIGS. 1–12 Preferred Embodiment

| PARTS LIST: | |
|---|---|
| Clamp and Axle Assembly | 30 |
| Razor Blade Gripping Jaw Members | 1, 2 |
| Arrow Broadhead Gripping Jaw Members | 13, 14 |
| Jaw Member sub-parts: | |
| Outside Planer Surface | 20 |
| Base Planer Surface | 21 |
| Gripping Surface | 22 |
| Shelf Edge | 23 |
| Structural Shelf | 24 |
| Two-Sided Recessed Channel: | |
| Wider Side | 25 |
| Narrow Side | 26 |
| Semi-Elliptical Recess | 27 |
| Bolt | 3 |
| Bolt Head | 3a |
| Recessed Channel | 3b |
| Bolt Shaft | 3c |

-continued

| PARTS LIST: | |
|---|---|
| Base Plate | 4 |
| Base Plate Hole | 4a |
| Base Plate Extensions | 4b, 4c |
| Spacing Washer | 5 |
| Cylindrical Bearing | 6 |
| Tensioning Nut | 7 |
| Compressible Ring | 8 |
| Frame | 9 |
| Hole in Square End of Frame | 9a |
| Hole in Round End of Frame | 9b |
| Inner Enlarged Orifice | 9c |
| Outer Enlarged Orifice | 9d |
| Cylindrical Roller | 10 |
| Roller Axles 2 | 10a, 10b |
| Bracket | 11 |
| Bracket Arms | 11a, 11b |
| Axle Hole in Bracket Arms | 11c, 11d |
| Screw Holes in Bracket Arms | 11e, 11f |
| Screws | 12a, 12b |

DETAILED DESCRIPTION

Description—FIGS. 1–10—Preferred Embodiment

A preferred embodiment of the self-aligning blade angle guide includes: a clamp and axle assembly 30, (FIGS. 1 and 2) which is designed to interchangeably retain one of two matched pairs of special purpose jaw members. Each matched pair differs in configuration and purpose.

A first pair of jaw members 1, 2 (FIGS. 3 and 4) is designed to grip razor blades and other small flat bodied blades.

A second pair of jaw members 13, 14 (FIGS. 5 and 6) is designed to grip arrow broadheads.

Either pair of jaw members 1, 2 (FIGS. 3 and 4) or 13, 14 (FIGS. 5 and 6) may be selectably installed in the clamp and axle assembly 30 by the user, depending on the type of blade to be sharpened.

Figure 9:
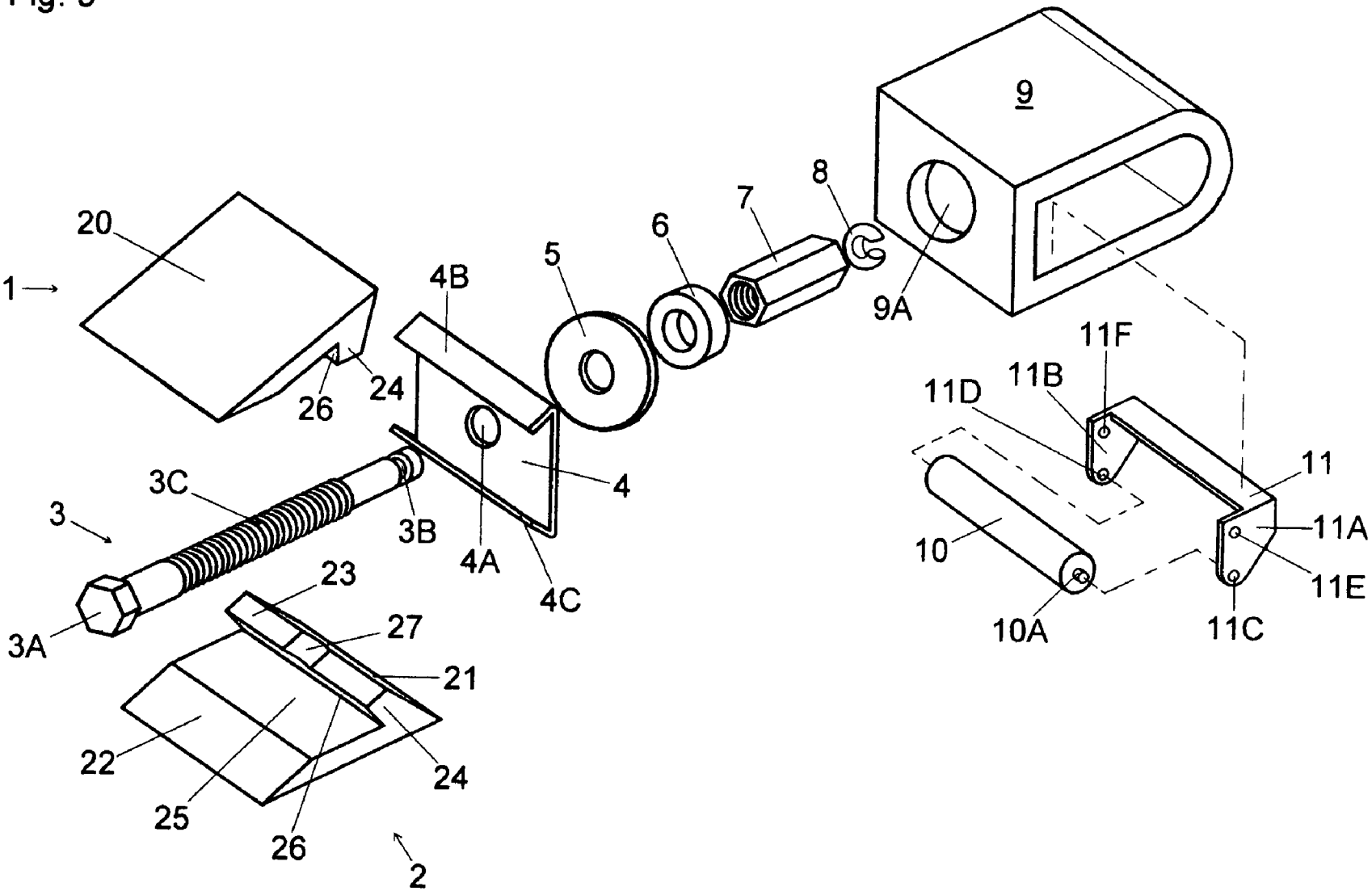
FIG. 9 is an exploded view of a preferred embodiment of the invention (shown with the razor blade gripping jaw members 1, 2).

The clamp and axle assembly 30 further includes a bolt 3 having at its first end a bolt head 3*a*, which is standard hexagonal in configuration. Extending from the bolt head 3*a* is a threaded bolt shaft 3*c*. Mounted on the bolt shaft 3*c* is a base plate 4, a spacing washer 5, a cylindrical bearing 6, and a tensioning nut 7. Further, a recessed channel 3*b* encircles the bolt shaft 3*c* near its terminal end (FIG. 9).

Figure 7:
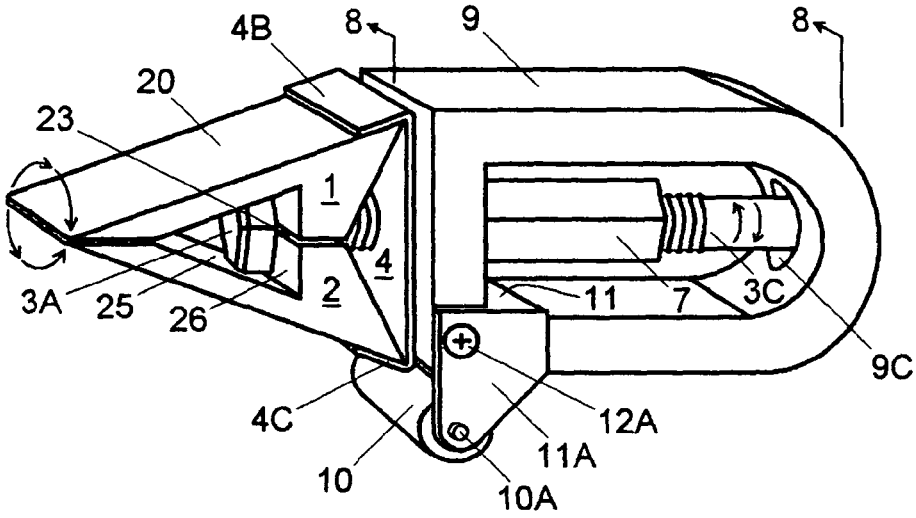
FIG. 7 is a perspective front/side view of a preferred embodiment of the invention.
Figure 11:
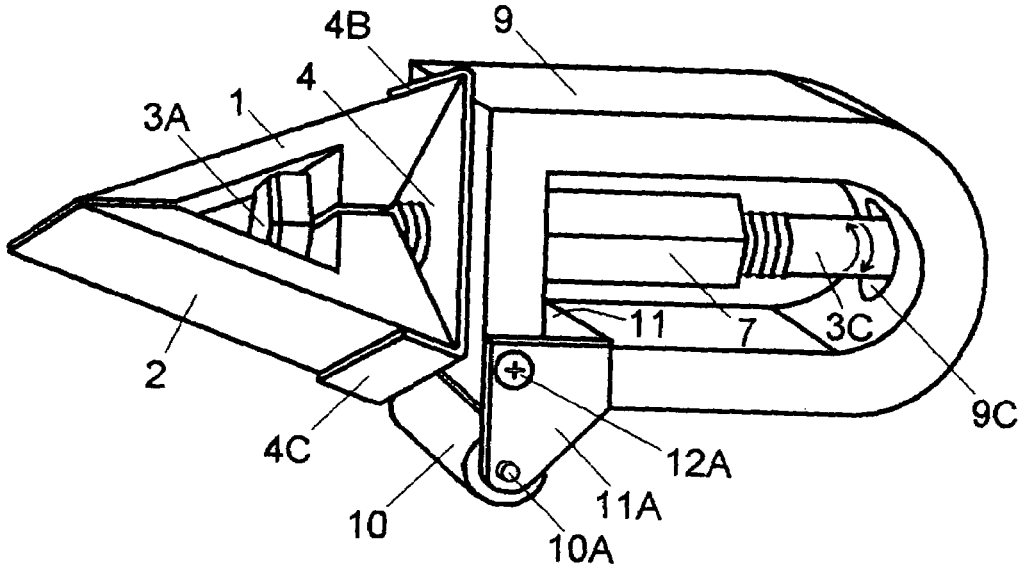
FIGS. 11 and 12 are perspective views of a preferred embodiment of the invention illustrating the rotational capability of the clamp and axle assembly (shown with the razor blade gripping jaws 1, 2 installed)
Figure 12:
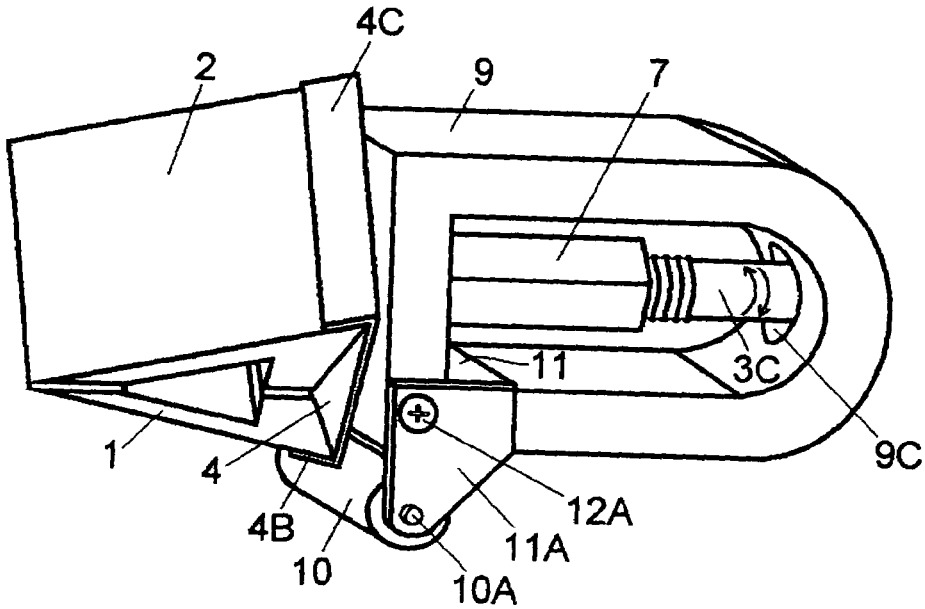

A preferred embodiment further includes a hand-held frame 9 (FIGS. 7 and 8) to which the clamp and axle assembly 30 is removably coupled by a semi-circular compressible ring 8 (FIG. 9) which is engaged in the recessed channel 3*b* of the bolt shaft 3*c*. Additionally, a bracket 11 and roller 10 assembly (FIG. 9) is secured to the underside of the frame 9. When coupled to the frame 9 the clamp and axle assembly 30 is freely rotatable within the frame 9 (FIGS. 7, 11, and 12).

Figure 1:
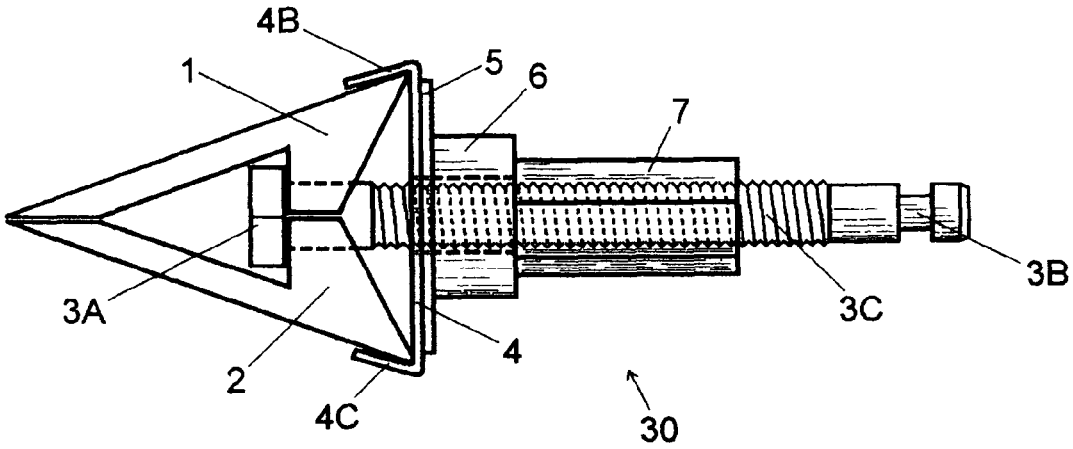
FIG. 1 is a side view of the clamp and axle assembly 30 with the razor blade gripping jaw members 1, 2 installed.

FIG. 1 shows the clamp and axle assembly 30 comprised of two individual jaw members 1, 2 of like profile and dimension, arranged in opposition with the head 3*a* of the bolt 3 captured in a recess between the jaw members 1, 2 and the bolt shaft 3*c* extending out through an aperture in the base of the jaw members 1, 2.

The base plate 4 captures and retains the jaw members 1, 2 and bolt head 3*a* in combination. The base plate 4 has a hole 4*a* in its center through which the bolt shaft 3*c* extends.

Following the base plate 4 on the bolt shaft 3*c* is a large spacing washer 5 followed by a cylindrical bearing 6, a tensioning nut 7 and the recessed channel 3*b* encircling the bolt shaft 3*c* near its terminal end.

Figure 2:
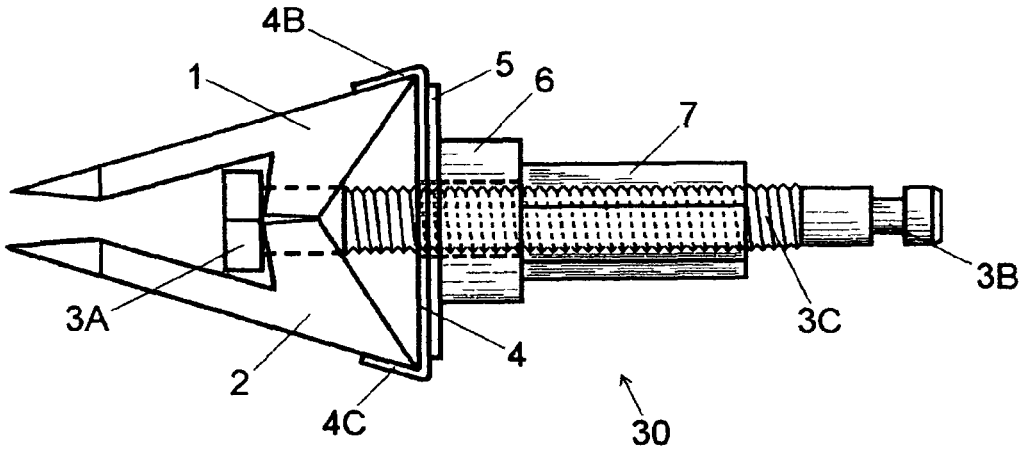
FIG. 2 is a side view of the clamp and axle assembly 30 with the arrow broadhead gripping jaw members 13, 14 installed and the jaws 13, 14 in an open position.

FIG. 2 is a side view of the clamp and axle assembly 30 with the arrow broadhead gripping jaws 1, 2 installed and in an opened position.

Figure 3:
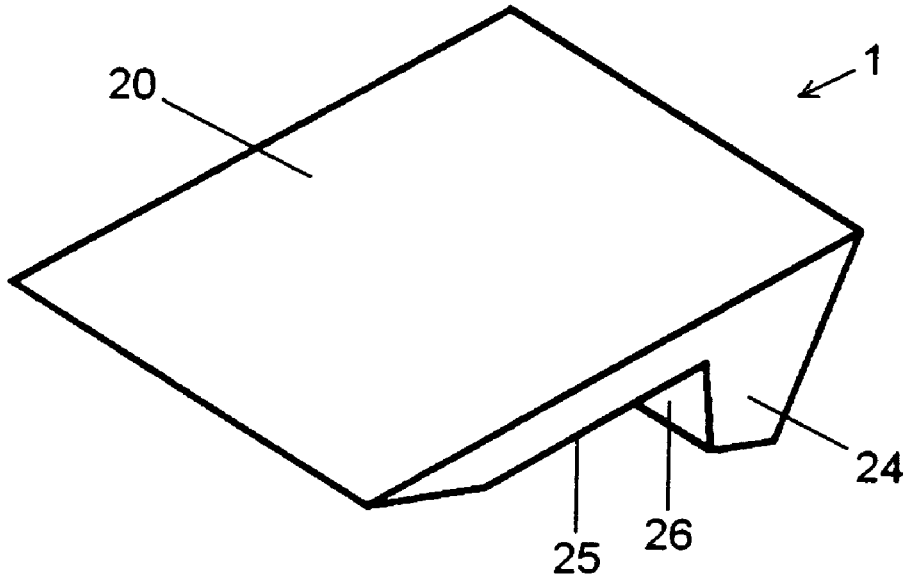
FIG. 3 is a perspective front/top/side view of a razor blade gripping jaw member 1.
Figure 4:
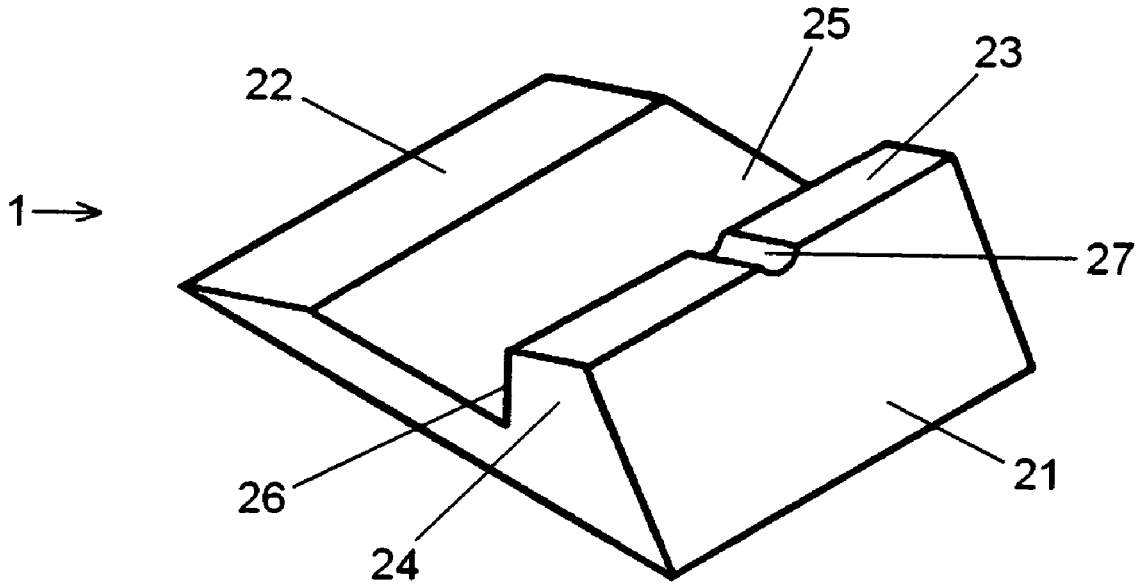
FIG. 4 is a perspective rear/bottom/side view of a razor blade gripping jaw member 1.

Now in greater detail, the specific configuration of the individual razor blade gripping jaw members 1, 2 is shown in perspective views in FIG. 3 (top view) and FIG. 4 (bottom view). While FIGS. 3 and 4 designate the illustrated jaw member 1, the jaw member 2 is a precise duplicate of jaw member 1 and a matched pair is arranged in opposition when installed in the clamp and axle assembly 30. Constructed of rigid material and being of like profile and dimension, the jaw members 1, 2 are of appropriate width to securely grip a razor blade, small straight edged specialty blade, or the like.

Figure 5:
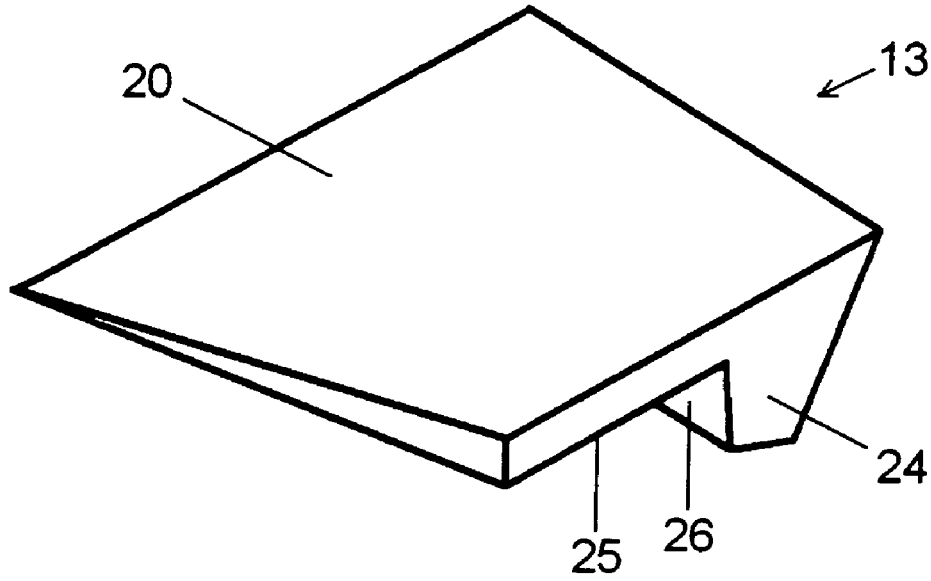
FIG. 5 is a perspective front/top/side view of an arrow broadhead gripping jaw member 13.
Figure 6:
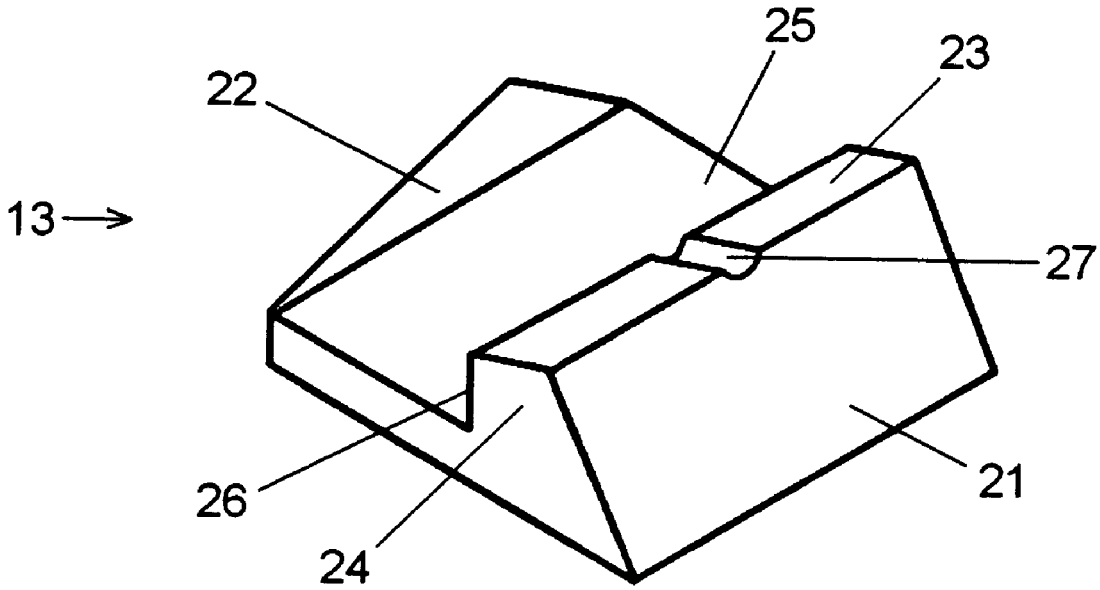
FIG. 6 is a perspective rear/bottom/side view of an arrow broadhead gripping jaw member 13.

The specific configuration of the individual arrow broadhead gripping jaw members 13, 14 is shown in perspective views in FIGS. 5 (top view) and 6 (bottom view). FIGS. 5 and 6 show that the broadhead gripping jaw members 13, 14 are precisely similar to the razor blade gripping jaw members 1, 2 with a single exception: the terminal ends of the razor blade gripping jaw members 1, 2 are perpendicular to the sides of the jaw members 1, 2 whereas the terminal ends of the broadhead gripping jaw members 13, 14 are cut or formed at an angle to the sides of the jaw members 13, 14.

Figure 10:
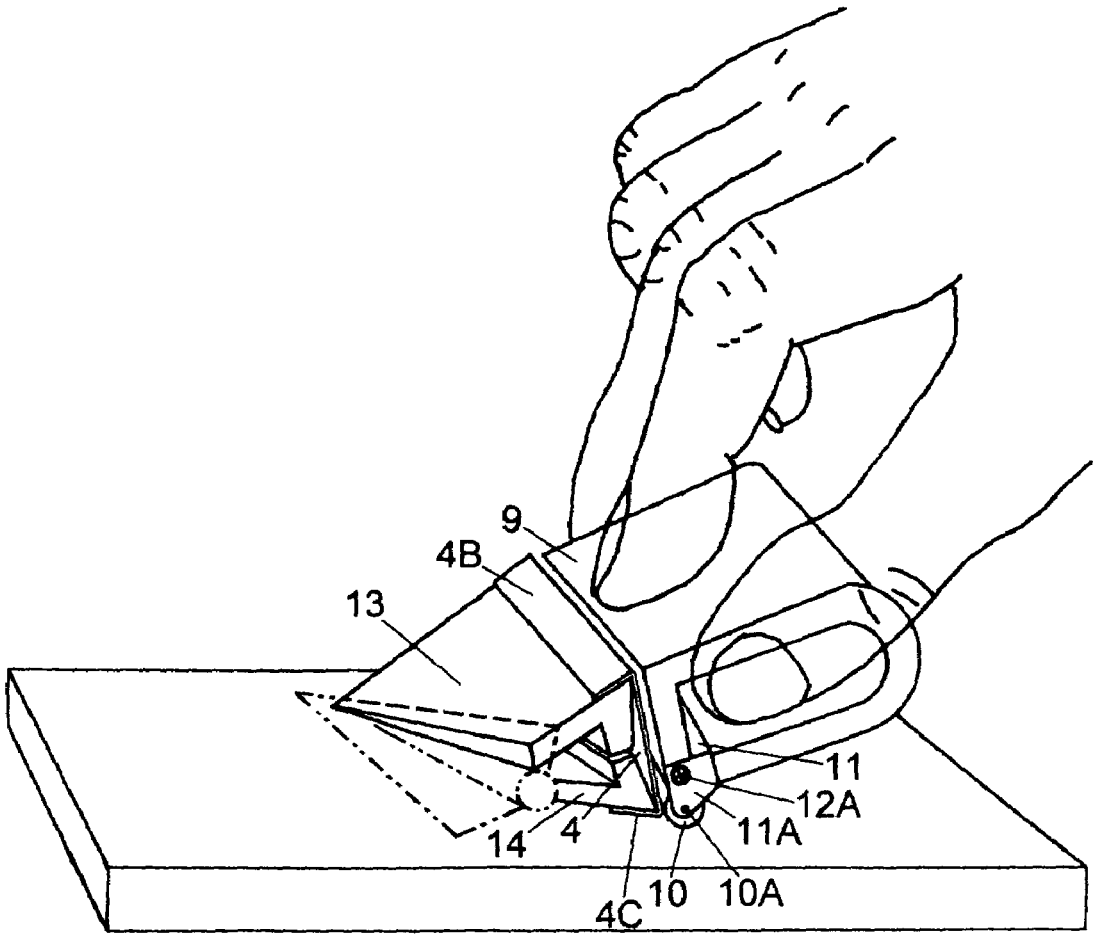
FIG. 10 is a perspective operational view of a preferred embodiment of the invention, with an arrow broadhead secured in the jaws 13, 14.

The angle is such that when the jaw members 13, 14 are installed in the clamp and axle assembly 30 a conventional two-bladed arrow broadhead may be secured in the jaws 13, 14 in an orientation which positions one blade of the arrow broadhead between the blade gripping surfaces 22 and the opposite blade roughly parallel with the base edge of the jaws' 13, 14 outside planer surfaces 20 (FIG. 10).

While FIGS. 5 and 6 designate the illustrated jaw member 13, the jaw member 14 is a precise duplicate of jaw member 13 with one exception: to create a working pair, the terminal ends of the jaw members 13, 14 are cut or formed at opposite angles from one another so that when the two are arranged in opposition, inside to inside, the terminal ends are parallel and aligned.

FIGS. 3–6 show that each jaw member 1, 2, 13, 14 has an outside planer surface 20 a base planer surface 21 and two separate inside planer surfaces; a blade gripping surface 22 at the forward end, and a shelf edge 23 at the base end, the two being separated by a two sided recess which forms a structural shelf 24 at the base of each jaw member 1, 2, 13, 14. The sides of the recess are of substantially differing widths.

The narrower side 25 of the recess is perpendicular to the shelf edge 23 and sufficiently deep to accommodate one half of the width of the bolt head 3*a*, and the wider side 26 of the recess is parallel with the outside planer surface 20.

Furthermore, FIGS. 4 and 6 show that the shelf edge 23 is perpendicularly bisected by a semi-elliptical recess 27. The width of the recess 27 is similar to the diameter of the bolt shaft 3*c*. The depth of the recess 27 is less than one-half of the diameter of the bolt shaft FIG. 7 shows the clamp and axle assembly 30 with the razor blade gripping jaws 1, 2 (FIGS. 3 and 4) installed and the clamp and axle assembly 30 coupled to the hand-held, hollow-bodied frame 9. The cylindrical roller 10 is securely mounted in the bracket 11 which is attached to the frame 9 with two screws 12*a*.

Referring to FIGS. 1 and 9 to further detail the clamp and axle assembly 30, FIG. 1 shows the arrangement of components in the assembly 30, and FIG. 9 provides perspective views of each individual component.

FIG. 1 shows two individual jaw members 1, 2, (FIGS. 3 and 4) arranged in opposition inside to inside, with the bolt head 3*a* captured in the enlarged recess formed between the jaw members 1, 2, the underside surface of the bolt head 3*a* resting on each structural shelf 24 and the bolt shaft 3*c* captured between the two semi-elliptical recesses 27.

FIGS. 1 and 9 further show that the jaw members 1, 2 and bolt head 3*a* in combination are captured and held in position by the base plate 4 which is rectangular in shape and constructed of stiff, flexible material. The bolt shaft 3*c* extends out through the hole 4*a* in the center of the base plate 4. The diameter of the hole 4*a* closely matches the diameter of the bolt shaft 3*c*. Additionally, each long edge of the rectangular base plate 4 has a continuous narrow extension 4*b*, 4*c*, which is folded or formed to capture the base portion of each jaw member's outside planer surface 20. The span of the base plate 4 between the extensions 4*b*, 4*c* is such that each jaw members' semi-elliptical recess 27 is held tightly against the bolt shaft. The width of the base plate 4 is similar to the width of the jaw members 1, 2, 13, 14.

Continuing with FIGS. 1 and 9, the spacing washer 5 is constructed of rigid material with a low friction finish. The spacing washer 5 is positioned on the bolt shaft 3*c* against the outside surface of the base plate 4. The spacing washer 5 has an inside diameter closely matching the outside diameter of the bolt shaft 3*c*, and an outside diameter that is slightly less than the height of the base plate 4.

The cylindrical bearing 6 is constructed of rigid material with a low friction finish and is positioned on the bolt shaft 3*c* against the spacing washer 5. The inside diameter of the bearing 6 closely matches the primary diameter of the bolt shaft 3*c*, and the outside diameter of the bearing 6 closely matches the diameter of the hole 9*a* in the forward end of the frame 9.

The threaded tensioning nut 7 is engaged on the threads of the bolt shaft 3*c* and positioned against the cylindrical bearing 6. The tensioning nut 7 has an outside diameter, which is smaller than the outside diameter of the cylindrical bearing 6.

Shortly beyond the tensioning nut 7 on the bolt shaft 3*c*, the threads terminate and the remaining portion of the bolt shaft 3*c* is slightly reduced in diameter. The recessed channel 3*b* encircles the bolt shaft 3*c* near its terminal end. The channel 3*b* is sufficiently deep to permit the ring 8 to compress into the channel 3*b* to the point where the ring 8 is sufficiently reduced in diameter to pass through the hole 9*b* in the frame 9.

Figure 8:
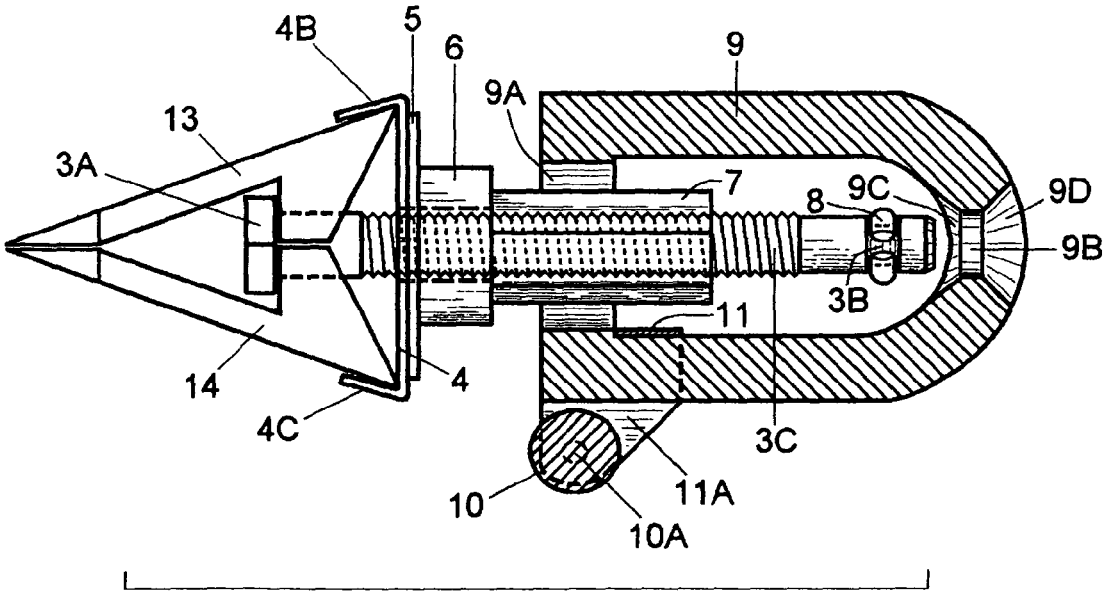
FIG. 8 is a cut away side view of a preferred embodiment of the invention, showing the clamp and axle assembly 30 partially inserted into the frame 9, with the frame 9, roller 10, and bracket 11 shown in cross section.

Completing the description of the clamp and axle assembly 30, FIGS. 8 and 9 show the compressible ring 8. The ring 8 is constructed of flexible, resilient material and is circular in cross section. The outside diameter of the ring 8 is similar to the primary diameter of the bolt shaft 3*c*, and the inside diameter of the ring 8 is larger than the diameter of the bolt shaft 3*c* within the recessed channel 3*b*. The width of the ring 8 is similar to the width of the channel 3*b*. The opening in the ring 8 is small enough to require the ring 8 to be snapped into the channel 3*b*, while large enough to allow the ring 8 to be compressed to match the inside diameter of the hole 9*b* in the rear of the frame 9.

The frame 9 for the clamp and axle assembly 30 is shown in FIGS. 7–12. The frame 9 is constructed of rigid material and is basically a tubular rectangular block of which the corners have been rounded top and bottom at one end creating an elongated "D" shape. The height and width of the frame 9 are similar to the height and width of the base plate 4.

FIG. 8 shows the frame 9 in cross section. The hole 9*a* is centered in the square end of the frame 9. The diameter of the hole 9*a* closely matches the outside diameter of the cylindrical bearing 6. The second hole 9*b* is centered in the rounded end of the frame 9, and the diameter of the hole 9*b* is slightly smaller than the outside diameter of the compressible ring 8. Further, the hole 9*b* shares a common centerline with the hole 9*a* in the square end of the frame 9. Additionally, the orifices 9*c* (inner) 9*d* (outer) of the hole 9*b* are conically enlarged or reamed to match the outside diameter of the compressible ring 8.

FIG. 8 further shows that the length of the frame 9 is such that when the clamp and axle assembly 30 (FIGS. 1 and 2) is fully inserted into the frame 9, the spacing washer 5 will rest against the outside of the square end of the frame 9 and the compressible ring 8 will be captured in the rear tapered orifice 9*c* of the hole 9*b*.

FIG. 9 shows the cylindrical roller 10 being similar in length to the width of the frame 9. An axle 10*a* extends from each end of the roller 10. The roller 10 is retained by the bracket 11 which extends through the forward base section of the frame 9. The bracket 11 is similarly bent 90 degrees at each end to form two arms 11*a*, 11*b*, which extend down beyond the base of the frame 9. Each arm 11*a*, 11*b* has a hole 11*c*, 11*d* near its terminal end which captures An axle 10*a* of the roller 10, and each arm 11*a*, 11*b* has a second hole 11*e*, 11*f* positioned above the axle hole 11*c*, 11*d*, the diameter of which is suitable to accept the mounting screw 12*a* which attached the bracket 11 to the frame 9.

Additionally, the terminal ends of both bracket arms 11*a*, 11*b* are rounded to a radius which is smaller than that of the cylindrical roller 10, and are angled along their back edges from the radius to the point where the bracket arm 11*a*, 11*b* meets the frame 9.

FIG. 9 further shows that the portion of the bracket 11 that extends through the frame 9 is reduced in width so that the bracket 11 can be moved forward to position the forward edge of each bracket arm 11*a*, 11*b* flush with the forward edge of the frame 9.

While the preferred embodiment of the invention is shown in a particular configuration, it should be understood that the invention is not limited to the particular construction shown, and that it is the intention to hereby cover any and all adaptations, and modifications which come within the spirit and scope of the appended claims.

Operation of the Preferred Embodiment: FIGS. 1–10

The invention utilizes a unique symmetrical clamp and axle assembly 30 (FIGS. 1 and 2) which is designed to interchangeably retain one of two pairs of special purpose jaw members 1, 2 (FIGS. 3 and 4) or 13, 14 (FIGS. 5 and 6). This assembly 30 is removably coupled to a hand-held frame 9 (FIGS. 7 and 8) which has a cylindrical roller 10 mounted in a bracket 11 below the forward end of the frame 9. While coupled to the frame 9, the clamp and axle assembly 30 is freely rotatable within the frame (FIGS. 7, 11, and 12).

As shown in FIGS. 1, 2 and 9, one of two pairs of jaw members 1, 2 or 13, 14 are arranged in opposition with the bolt head 3*a* captured in the recess between the jaw members 1, 2, or 13, 14 and the bolt shaft 3*c* captured between the two semi-elliptical recesses 27. The semi-elliptical recesses 27 serve to align the jaw members 1, 2 or 13, 14 and to prevent linear movement of the individual jaw members 1, 2 or 13, 14 within the base plate 4.

The jaw members 1, 2 or 13, 14 and bolt 3 in combination are captured by the tight fitting base plate 4. The base plate 4 has a hole 4*a* in its center through which the bolt shaft 3*c* extends and through which the bolt shaft 3*c* can be reciprocally moved. Each long edge of the base plate 4 has a continuous narrow extension 4*b*, 4*c* which serves to tightly capture the base portion of each jaws' 1, 2 or 13, 14 outside planer surface 20. The base plate 4, the semi-elliptical recesses 27, and the bolt shaft 3*c* in combination, serve to position and retain the jaw members 1, 2 or 13, 14 within the clamp and axle assembly 30.

Continuing with FIGS. 1, 2 and 9;

Against the base plate 4 on the bolt shaft 3*c* is the large diameter spacing washer 5 which serves to maintain rotational clearance between the base plate 4 and the frame 9 when the clamp and axle assembly 30 is coupled to the frame 9, and also serves to support and stiffen the base plate 4 when the nut 7 is tightened.

The cylindrical bearing 6 is positioned on the bolt shaft 3*c* against the spacing washer 5 and serves to support the forward end of the clamp and axle assembly 30 when the assembly 30 is inserted into the frame 9, and permits the clamp and axle assembly 30 to freely rotate in either direction within the frame 9.

The nut 7 is engaged on the threads of the bolt shaft 3*c* and positioned against the bearing 6. The nut 7 is tightened to close the jaws 1, 2 of the clamp (FIG. 1) and loosened to open the jaws 13, 14 (FIG. 2).

Shortly beyond the nut 7 the threads of the bolt shaft 3*c* terminate and the bolt shaft 3*c* is slightly reduced in diameter. The portion of the bolt shaft 3*c* which is reduced in diameter and the bearing 6 provide smooth surfaces on which the clamp and axle assembly 30 rotates within the frame 9, and in combination provide support for, and stabilized rotation of, the clamp and axle assembly 30 within the frame 9 (FIGS. 7, 11, and 12).

The channel 3*b* encircles the bolt shaft 3*c* near its terminal end. The channel 3*b* serves as a seat for the ring 8, and provides a recess for the ring 8 to compress into, permitting the ring 8 to pass through the hole 9*b* in the rear of the frame 9.

FIG. 8 shows the semi-circular compressible ring 8 engaged in the recessed channel 3*b* encircling the bolt shaft 3*c*. The compressible ring 8 serves to removably couple the clamp and axle assembly 30 to the frame 9 while permitting the assembly to freely rotate in either direction within the frame 9.

Removal and installation of the different styles of jaw members 1, 2 (FIGS. 3 and 4)), 13, 14 (FIGS. 5 and 6) is performed by the user when changing from sharpening razor blades to sharpening arrow broadheads or vice versa. To remove either set of jaws 1, 2 or 13, 14 the clamp and axle assembly 30 is first removed from the frame 9 and the nut 7 loosened to the extreme rear of the threaded portion of the bolt shaft 3*c*. Next the bolt 3 is pushed backward through the hole 4*a* in the base plate 4, forcing the jaws to open widely as the bolt head 3*a* moves into the narrow opening between the gripping surfaces 22. The user then grips one jaw member 1, 2 or 13, 14 in each hand and continues to open the clamp even further, which causes the individual jaw members 1, 2 or 13, 14 to disengage both the base plate 4 and the bolt shaft 3*c*, and snap out of the assembly.

To install either set of jaws 1, 2 or 13, 14 the clamp and axle assembly 30 is removed from the frame 9 and the tensioning nut 7 is loosened to the extreme rear of the threaded portion of the bolt shaft 3*c*.

Next the bolt shaft 3*c* is pushed backward through the base plate 4 to a point which permits a chosen pair of jaw members 1, 2 or 13, 14 to be arranged in opposition inside the base plate 4 with the bolt head 3*a* positioned between the blade gripping surfaces 22, each semi-elliptical recess 27 straddling the bolt shaft 3*c*, and the base edge of each jaw members' 1, 2 or 13, 14 outside planer surface 20 contacting the inside surface of the base plate 4.

The bolt shaft 3*c* is then pulled back through the hole 4*a* until the underside surface of the bolt head 3*a* contacts the structural shelves 24. The bolt is then rotated to position two opposing flat sides of the bolt head 3*a* parallel with the shelf edges 23. Continuing to pull the bolt 3 through the hole 4*a* in the base plate 4 causes the individual jaw members 1, 2 or 13, 14 to pivot towards each other on the base edges of their outside planer surfaces 20, and snap into place, capturing the bolt head 3*a* in the recess between the jaws 1, 2 or 13, 14 in a position that prevents the head 3*a* from turning inside the recess. The tensioning nut 7 is then tightened into its working range.

The tolerance between the bolt head 3*a*, and the recess created by arranging two jaw members 1, 2 or 13, 14 in opposition is close enough to prevent the bolt 3 from turning with the nut 7, as the nut 7 is tightened or loosened, while loose enough to permit the jaws 1, 2 to close.

Regardless of which particular pair of jaws 1, 2 or 13, 14 is installed in the clamp and axle assembly 30, as the nut 7 is tightened, the bolt head 3*a* is drawn down on the structural shelves 24 forcing the jaws 1, 2 or 13, 14 to pivot towards each other, closing the terminal ends of the jaws 1, 2 or 13, 14 tightly on the blade.

To sharpen a razor blade or other straight-edged, flat-bodied blade, the razor blade gripping jaws 1, 2 are installed in the clamp and axle assembly 30 (FIG. 1) as outlined above, and the nut 7 slightly loosened to allow the jaws 1, 2 to open.

A blade is then placed between the jaws 1, 2 and oriented with the edge to be sharpened positioned roughly parallel to the front and rear edges of the jaws' outside planer surfaces 20, and extending approximately one quarter of one inch out of the terminal ends of the jaws 1, 2, The nut 7 is then tightened to secure the blade in the assembly 30.

To sharpen a conventional two-bladed arrow broadhead, the broadhead gripping jaws 13, 14 are installed in the clamp and axle assembly 30 (FIG. 2) as outlined above, and the nut 7 slightly loosened to allow to the jaws 13, 14 to open.

Next, the broadhead is positioned with one blade between the jaws 13, 14, and the opposite blade (the blade to be sharpened) oriented roughly parallel with the base edge of the jaws' 13, 14 outside planer surfaces 20. The nut 7 is then tightened to secure the broadhead in the assembly 30.

FIG. 7 shows the clamp and axle assembly 30 coupled to the frame 9, and shows the roller 10 mounted in the bracket 11 below the forward end of the frame 9. The bracket 11 serves to position and retain the roller 10, while permitting the roller to turn in either direction.

The roller 10 supports the frame 9 during the sharpening process, and provides a durable point of contact with the sharpening surface, which insures that the sharpening angle does not change over the life of the device.

Referring now to FIG. 8, to couple the clamp and axle assembly 30 to the frame 9 the user takes the clamp and axle assembly 30 in one hand, and the frame 9 in the other hand and inserts the terminal end of the bolt shaft 3*c* into the frame 9 through the hole 9*a* and on into the hole 9*b*.

As the terminal end of the bolt shaft 3*c* enters the hole 9*b* at the rear of the frame 9, the compressible ring 8 engages the enlarged orifice 9*c* of the hole 9*b*, resisting further travel of the bolt shaft 3*c*. Simultaneously, the bearing 6 begins to enter the hole 9*a*.

The user then applies light pressure to force the ring 8 into, and through, the hole 9*b*, where it is first compressed to a reduced diameter by the enlarged orifice 9*c*, which serves as a forcing cone, then passes through the cylindrical core of the hole 9*b*, and expands to its original diameter in the orifice 9*d* upon exiting the hole 9*b*, coupling the clamp and axle assembly 30 to the frame 9 in snap-in, snap-out fashion. As the ring 8 passes through the hole 9*b*, the bearing 6 seats in the hole 9*a*, and the washer 5 comes to rest against the forward end of the frame 9.

Similarly, to remove the clamp and axle assembly 30 from the frame 9, the user grasps the frame 9 in one hand and the clamp and axle assembly 30 in the other hand, and simply pulls the two apart. The enlarged orifice 9*d* acts as a forcing cone to compress the ring 8, permitting the ring 8 to be pulled back through the hole 9*b*, releasing the clamp and axle assembly 30 from the frame 9.

This snap connection, while securely coupling the clamp and axle assembly 30 to the frame 9, also permits free rotation of the clamp and axle assembly 30 within the frame 9 (FIGS. 7, 11, and 12). The bolt shaft 3*c* doubling as an axle, is supported at the front of the frame 9 by the cylindrical bearing 6 in its corresponding hole 9*a*, and is further supported at the rear of the frame 9 by the bolt shaft 3*c* in the hole 9*b*.

The physical procedure for sharpening blades is the same regardless of which particular pair of jaws 1, 2 or 13, 14 is installed in the clamp and axle assembly 30; and regardless of the particular blade configuration, any blade to be sharpened is oriented in the jaws 1, 2, or 13, 14 with the edge to be sharpened positioned roughly parallel with the base edge of the jaw members' outside planer surfaces 20.

Referring now to FIG. 10, after installing the desired jaws 1, 2 or 13, 14 in the clamp and axle assembly 30, and after securing a blade to be sharpened in the jaws 1, 2 or 13, 14, the user snaps the assembly 30 into the frame 9 and grasps the frame 9 in a manner which places the sides of the frame 9 between thumb and middle finger and places the index finger on the top surface of the frame 9 back from the base plate 4, (to avoid interfering with the rotation of the clamp and axle assembly 30).

The device is then placed on a flat abrasive surface, such as a whetstone, with only the roller 10 contacting the surface of the stone. The weight of the frame 9 and any added pressure applied by the user is evenly distributed along the length of the roller 10, which stabilizes the frame 9 on the surface of the whetstone.

The user next tips the device forward to bring the blades' edge into contact with the whetstone. As the blades' edge contacts the stone, a portion of the pressure being born by the roller 10 is shifted to the blade, and transferred through the blade to the clamp and axle assembly 30. If the blade is not properly aligned in the jaws 1, 2, or 13, 14, or if the clamp and axle assembly 30 is rotated to any position which presents the blades' edge to the stone at an angle which is not parallel with the surface of the stone, one end of the blades' edge will contact the surface before the other, causing the clamp and axle assembly 30 to rotate on its axis, until the entire length of the blades' edge contacts the surface of the whetstone.

The device is then manually rolled forward along the length of the stone with light pressure being applied to lap the first side of the blades' edge.

Next, the user lifts the device from the whetstone, and with the free hand, manually rotates the clamp and axle assembly 30 approximately 180 degrees within the frame 9 to present the opposite side of the blades' edge for a similar pass across the stone. Again, as the blade contacts the surface of the whetstone, the clamp and axle assembly 30 automatically rotates to the point where the entire length of the blade is uniformly contacting the stone. This process is repeated, rotating the assembly 30 180 degrees after each pass until the blade is sharp.

This self-aligning feature ensures continuous, uniform contact between the entire length of the blades' edge and the surface of the whetstone, and pressure being equally distributed to all points along the length of the blades' edge at all times during the sharpening process. Further, the rotational capability of the clamp and axle assembly permits the user to service both sides of the blades' edge in a single blade clamping operation and by rotating the clamp and axle assembly 180 degrees between passes over the whetstone.

Thus, each side of the blade is ground equally, burrs and filings are not permitted to build-up on either side of the blade's edge, a uniform double bevel is maintained, and a superior method of sharpening, requiring minimal skill, is easily utilized, resulting in a superior edge with a greater degree of sharpness.

CONCLUSION, RAMIFICATIONS AND SCOPE OF INVENTION

Thus, the reader will see that the invention provides a technological advancement in the field of manual sharpening devices and a simplification of the manual sharpening process for both skilled and unskilled users while encouraging the user to utilize a superior method of sharpening.

While the preceding description contains many specificities, these should not be construed as limitations to the spirit or scope of the invention but rather to serve as an exemplification of one preferred embodiment. Many other variations in design are possible, for example:

The mechanical design of the clamp may be changed to any configuration that achieves the goal of securely gripping the blade, such as a clamp having two jaw members, of which at least one is pivotable towards the other, with one jaw member having a hole through which a threaded fastener is passed to engage a similarly threaded receiver in the opposite jaw member, whereby tightening the threaded fastener pulls the jaw members towards each other to grip the blade.

Another possible clamp configuration comprises one fixed jaw member and one pivotable jaw member wherein a fulcrum and threaded set screw are used to pivot one jaw member towards the other to capture and secure the blade between the jaws.

Yet another possible clamp configuration is a spring-type clamp that grips the blade by means of an internal or external spring that applies constant pressure to close the jaws and is forcibly opened by applying pressure to the rear portion of the jaws or to a leveraged extension of the jaw or jaws.

An equally functional clamp construction utilizes two flexible springs or spring plates which are joined at one end and press against each other at the other end, whereby a narrow opening is created between the springs or spring plates at the front of the clamp, and the blade forced into the opening and held in place by spring tension.

Other clamp designs too numerous to list may be substituted as the particular clamp configuration is not critical to the function of the invention.

Likewise, the specific mechanical configuration and interaction of parts which enables the clamp to freely rotate may be changed and remain within the intended spirit of the disclosure, for example; the axle can be secured to the frame in a manner which prevents the axle from rotating and the clamp configured to rotate on or about the fixed axle, as the spirit of the disclosure is the rotational capability of the clamp, rather than the specific mechanical configuration used to achieve rotational capability.

Further variations in the means of coupling the clamp to the axle and/or the axle to the frame are similarly possible. For example, the axle may be integral to the clamp and removable from the frame, or the axle may be integral to the frame and removable from the clamp, or the axle can be removable from both the clamp and the frame, or the axle may be permanently attached to both the clamp and the frame, or any combination that provides for rotational capability of the clamp.

The shaft used to pivot the jaws does not need to double as the axle, the shaft may be shortened and a separate axle used to join the clamp assembly to the frame assembly, nor does the axle necessarily need to extend completely through the frame, the axle may be attached permanently or removably to the frame at only the front, or an offset bracket and axle assembly could be mounted anywhere on the frame and continue to function as intended.

The length and/or diameter of the axle relative to the clamp and to the frame could be increased or reduced to accommodate the particular clamp/axle/frame construction used. Likewise the shaft-type axle can be replaced by a spherical ball and socket joint for the purpose of connecting the clamp to the frame while providing for rotational capability of the clamp.

Furthermore, the spacing washer, cylindrical bearing and the tensioning nut could be consolidated into a one-piece construction or, if an alternative clamp configuration is used, the spacing washer, cylindrical bearing and tensioning nut may be eliminated entirely from the construction.

The semicircular compressible ring on the bolt shaft and its corresponding receptacle in the rear of the frame could be replaced by any number of mated fitting designs, which would serve the purpose of removably or permanently coupling the clamp to the frame, while providing for rotational movement of the clamp.

Likewise, the frame can be modified in numerous ways and continue to function within the spirit of the invention: the shape of the frame may be rectangular, square, or round, elliptical or any other shape. The frame could also be solid, rather than hollow. A simple elongated grip or handle having an axle, or configured to accept an axle, could be substituted for the preferred frame and would function adequately as described in the operation of the preferred embodiment.

The cylindrical roller may be changed to one or more wheels mounted on an axle or axles with appropriate mounting hardware used, or a spherical roller or rollers with appropriate mounting hardware may be substituted, or the cylindrical roller and its bracket may be eliminated entirely and a solid bar or shoulder substituted, which would serve to establish and maintain the sharpening angle.

The roller bracket may be modified as well by utilizing two separate bracket plates, one mounted on either side of the frame to capture the roller, or the bracket or brackets could be mounted elsewhere on the frame, or the bracket may be formed into the frame in a one-piece construction. The bracket may be constructed in any configuration designed to retain a particular style of roller or wheel for the purpose of supporting and positioning the frame during the sharpening process as outlined in the disclosure.

Accordingly, the scope of the invention should be determined not by the embodiment(s) illustrated, but by the appended claims and their legal equivalents.

The invention claimed is:

1. A self-aligning blade angle guide comprising:

(a) an axle having a first end and a second end;

(b) a clamp including, in combination, a pair of similar jaw members of predetermined shape arranged in opposition, means for attaching said first end of said axle to at least one said jaw member, a base having a hole through which said axle extends and releasably retaining said jaw members in combination with said first end of said axle, thereby forming a clamp-and-axle assembly, and means for imparting reciprocal movement to said axle, whereby said each jaw member is caused to pivot towards and away from the opposite said jaw member, thereby enabling the clamp to securely grip and release a blade;

(c) a frame removably coupled to the clamp-and-axle assembly so as to enable free rotational movement of the clamp-and-axle assembly through an angle of at least 180 degrees with respect to said frame; and (d) means for establishing and maintaining a predetermined sharpening angle, whereby a weight of said self-aligning blade angle guide, combined with any added pressure applied by the user, causes said clamp to rotate on its axis as the self-aligning blade angle guide is placed in operational position on the surface of a sharpening means, thereby aligning the edge of a blade secured in said clamp with the surface of the sharpening means, said rotational capability further enabling the user to sharpen both sides of a blade's edge with a single blade clamping operation by manually rotating said clamp at least 180 degrees between passes along the surface of the sharpening means.

2. A self-aligning blade angle guide of claim 1, wherein said clamp further includes:

(a) a plurality of matched pairs of jaw members, each matched pair of said jaw members being configured and adapted to securely grip a different style of blade; and (b) means for releasably retaining said matched pair of jaw members in said clamp, whereby the user may selectably interchange said matched pairs of jaw members within said clamp, thereby enabling the user to sharpen blades of differing styles and configurations.

3. The self-aligning blade angle guide of claim 1, wherein the means for establishing and maintaining a predetermined sharpening angle comprises:

(a) a bracket fixedly attached to the underside of said frame; and (b) a roller operatively retained by said bracket.

4. The self-aligning blade angle guide of claim 1, wherein said frame is adapted to be held in one hand of the user.

5. The self-aligning blade angle guide of claim 1, further comprising means for maintaining rotational clearance between said base and said frame.

6. The self-aligning blade angle guide of claim 1, further comprising means for supporting the clamp-and-axle assembly when the clamp-and-axle assembly is inserted into said frame, and for stabilizing rotation of the clamp-and-axle assembly within said frame.

7. The self-aligning blade angle guide of claim 1, further comprising means for removably coupling the clamp-and-axle assembly to said frame while permitting the clamp-and-axle assembly to freely rotate in either direction within said frame.

8. The self-aligning blade angle guide of claim 1, wherein said means for attaching said first end of said axle to said jaw members comprises:

(a) said axle having a head of predetermined size and configuration at said first end of said axle; and (b) each said jaw member having an inside surface and an outside surface, and each said jaw member further having a similar recess formed in its said inside surface, each said recess being configured to accept approximately one half of said head of said axle, whereby said jaw members may be arranged in opposition with said head of said axle captured in said recesses, with said jaw members and said axle being retained in combination by said base.

9. The self-aligning blade angle guide of claim 8, wherein said means for imparting reciprocal movement to said axle comprises:

(a) said axle being threaded; and (b) a tensioning nut having threads which are compatible with said threads of said axle, said tensioning nut being engaged on said second end of said axle, whereby tightening or loosening said tensioning nut moves said axle reciprocally through said hole of said base, whereby said jaw members are caused to pivot towards or away from each other, thereby enabling said jaw members to grip and release a blade.

* * * * *